US010221697B2

(12) United States Patent
Boeck et al.

(10) Patent No.: US 10,221,697 B2
(45) Date of Patent: Mar. 5, 2019

(54) TURBINE BLADE HAVING A SHROUD AND A CUTTING TOOTH

(71) Applicant: MTU Aero Engines AG, Munich (DE)

(72) Inventors: Alexander Boeck, Kottgeisering (DE); Manfred Feldmann, Eichenau (DE); Stephen Royston Williams, Seefeld (DE)

(73) Assignee: MTU Aero Engines AG, Munich (DE)

( * ) Notice: Subject to any disclaimer, the term of this patent is extended or adjusted under 35 U.S.C. 154(b) by 1243 days.

(21) Appl. No.: 14/101,956

(22) Filed: Dec. 10, 2013

(65) Prior Publication Data

US 2014/0178201 A1 Jun. 26, 2014

(30) Foreign Application Priority Data

Dec. 21, 2012 (EP) ..... 12198862

(51) Int. Cl.

| | |
|---|---|
| ***F01D 5/20*** | (2006.01) |
| ***F01D 5/22*** | (2006.01) |
| ***F01D 11/12*** | (2006.01) |

(52) U.S. Cl.

CPC ..... *F01D 5/20* (2013.01); *F01D 5/225* (2013.01); *F01D 11/122* (2013.01); *F01D 11/125* (2013.01); *F05D 2240/303* (2013.01); *F05D 2240/304* (2013.01)

(58) Field of Classification Search

CPC . F01D 5/20; F01D 5/225; F01D 11/02; F01D 11/122; F01D 11/125; F05D 2240/303; F05D 2240/304; F05D 2240/307

USPC ..... 415/173.1

See application file for complete search history.

(56) References Cited

U.S. PATENT DOCUMENTS

| | | | | |
|---|---|---|---|---|
| 8,152,455 | B2 * | 4/2012 | Wunderlich | F01D 11/08 415/173.1 |
| 2008/0075600 | A1 | 3/2008 | Moors | |
| 2011/0268574 | A1 | 11/2011 | Masserey et al. | |
| 2012/0195742 | A1 * | 8/2012 | Jain | F01D 11/122 415/173.1 |
| 2013/0028741 | A1 * | 1/2013 | Kleinow | F01D 5/225 416/183 |

FOREIGN PATENT DOCUMENTS

| | | |
|---|---|---|
| JP | 8 303 204 | 11/1996 |
| WO | WO 2010/034614 | 4/2010 |

* cited by examiner

*Primary Examiner* — Richard A Edgar
*Assistant Examiner* — Danielle M. Christensen
(74) *Attorney, Agent, or Firm* — Davidson, Davidson & Kappel, LLC

(57) ABSTRACT

A turbine blade (100) having an airfoil (1). In its radially outer region, the turbine blade (100) has at least one shroud (200) or at least one shroud segment, as well as at least one cutting tooth (300) which is intended to engage at least once into portions of a turbine casing during use of the turbine blade (100). The cutting tooth (300) is connected to the shroud (200) or the shroud segment.

8 Claims, 4 Drawing Sheets

TURBINE BLADE HAVING A SHROUD AND A CUTTING TOOTH

This claims the benefit of European Patent Application No. 12 198 862.0, filed Dec. 21, 2012 and hereby incorporated by reference herein.

The present invention relates to a gas turbine blade, in particular a turbine blade having an airfoil, a shroud or a shroud segment, and a cutting tooth.

BACKGROUND

In the art, there are known turbine blades having airfoils provided with shrouds having sealing lips. These are intended to prevent the medium passing through the turbines from flowing past the radially outer edge of the turbine blade, which would reduce the efficiency of the turbine.

SUMMARY OF THE INVENTION

It is an object of the present invention to provide a further turbine blade having an airfoil, a shroud or a shroud segment.

The present invention provides a turbine blade having an airfoil which has a shroud or a shroud segment at or in the radially outer region. In this radially outer region, the turbine blade further has at least one cutting tooth which is intended to engage at least once into at least one abradable coating of a turbine casing during use of the turbine blade. The cutting tooth may cut into a lining of the casing during a first start-up, a first rotation or during starting of the engine and thereby create a gap as a sealing gap between the turbine blade and the turbine casing. The cutting tooth is connected to the shroud or the shroud segment.

In all of the above and following discussion, the expressions "may be" and "may have", etc., will be understood to be synonymous with "is preferably" and "preferably has", respectively, and are intended to illustrate specific embodiments according to the present invention.

Advantageous refinements of the present invention are the subject matter of the respective dependent claims and specific embodiments.

Specific embodiments of the present invention may include one or more of the features mentioned below.

In certain embodiments according to the present invention, the cutting tooth is, in addition, connected to a sealing lip of the shroud or the shroud segment. A sealing lip may be an edge or rib of the shroud.

In several embodiments of the present invention, the cutting tooth is adapted to create or prepare a clearance seal between the turbine blade and a casing surrounding the turbine blade, the turbine casing. The clearance seal may be in the form of an abradable seal.

In certain embodiments of the present invention, the cutting tooth is intended to cut into a portion of the turbine casing lining, which portion may be referred to as abradable coating, during a first rotation or during start-up of an engine and to graze this portion or remove a portion of the lining in such a way that a gap is subsequently formed as a sealing gap between the turbine blade and the turbine casing. The lining of the turbine casing may have sealing segments, at least a portion of which has a so-called "honeycomb" structure (honeycombs). The sealing segments may be in the form of an abradable coating. However, the lining may take any other suitable form.

In certain embodiments according to the present invention, the cutting tooth is a portion of the airfoil. The cutting tooth may be an integral portion of the airfoil. In this context, the term "integral" is intended to mean that the cutting tooth and airfoil form a unit. A unit may mean that both parts (cutting tooth and airfoil) are made from one material and/or manufactured in a common manufacturing process or manufacturing step. A unit may further mean that both parts form one structural shape and/or fulfill a common function.

In several embodiments of the present invention, the cutting tooth with the portion of the airfoil is, in addition, also a portion of the shroud or the shroud segment. The cutting tooth, together with the portion of the airfoil, may be an integral portion of the shroud or the shroud segment. Similarly, the cutting tooth, together with the integral portion of the airfoil, may be an integral portion of the shroud or the shroud segment, or vice versa.

In many of the embodiments according to the present invention, the shroud of the turbine blade has a leading sealing lip and a trailing sealing lip. Both sealing lips extend or project radially beyond a top surface of the shroud. In this connection, the leading sealing lip may be longer in the radial direction and/or in the main direction of flow incidence on the turbine blade than the trailing sealing lip (either in absolute terms or as seen in the radial direction and/or in the main direction of flow incidence on the turbine blade and not in the circumferential direction).

In several embodiments of the present invention, the shroud of the turbine blade has a leading sealing lip and a trailing sealing lip. Both sealing lips extend or project radially beyond a top surface of the shroud. In this connection, the shroud, together with its leading and trailing sealing lips, has the shape of a trapezoid or rectangular trapezoid (possibly open in an upward or radial direction) in a cross-sectional plane through the turbine blade perpendicular to the top surface of the shroud and extending in the axial direction of the turbine blade.

In certain embodiments according to the present invention, the cutting tooth with the portion of the airfoil is configured as a stiffening element for the shroud or the shroud segment.

In several embodiments of the present invention, the term "stiffening element" is understood to mean a structural element by means of which greater stiffness is achieved for the respective portion surrounding the stiffening element or for the entire component as compared, for example, to a portion or component without a stiffening element. Greater stiffness may result in greater strength and/or greater stability of the component. Furthermore, a stiffening element may be used to optimize dynamic properties of the respective portion or of the entire component. The stiffening may, for example, cause a change in the vibration characteristics, such as shifts in the resonant frequency or in the natural frequency. The natural frequency may be shifted to vibration frequency ranges further away from the operating point and/or design point of the component. By using a stiffening element, critical vibrations can be prevented or reduced.

In some embodiments of the present invention, the cutting tooth is configured as a continuous extension of the airfoil. For example, the airfoil may first of all be extended in a direction toward the shroud or the shroud segment and along the same. The cutting tooth may be formed adjacent to or as a radial termination of this extension (see also FIGS. 2 and 3). This extension with the formed cutting tooth may be an integrally formed part, for example, a continuous formed part where the surfaces of the cutting tooth, the sealing lip of the shroud and the extended airfoil merge into one another.

In certain embodiments according to the present invention, at least one portion of the shroud is extended beyond a shroud cutback.

In several embodiments of the present invention, the term "shroud cutback" is understood to mean a shroud width (meaning the width of the base area of the shroud) which is smaller than the turbine blade chord length projected perpendicular to the axis of rotation. This means that the turbine blade chord length so projected extends beyond the shroud. However, this does not mean that possible shroud edges, which may be inclined outwardly, could not extend beyond the chord length. The width of the "shroud cutback" indicates the width or distance (e.g., in millimeters or centimeters) by which the chord of the turbine blade extends beyond the shroud or, in other words, the magnitude of the distance of the "cutback" of the shroud with respect to the turbine blade chord length so projected. To further illustrate this term, reference is made to FIG. 3 as a possible embodiment.

In certain embodiments according to the present invention, the portion of the shroud that is extended beyond the shroud cutback or the sealing lip or respective portions thereof are inclined at least 10° (for example, within a range of 10°-50°, 10°-30°, 10°-20°, 10°-15°) relative to a longitudinal blade axis against a main direction of flow incidence on the turbine blade, or less than 80° (for example, within a range of 50°-80°, 60°-80°, 70°-80°, 75°-80°) against the main direction of flow incidence on the blade, or less than 80° (for example, within a range of 50°-80°, 60°-80°, 70°-80°, 75°-80°) against the axial extent of the outer top surface of the shroud. The top surface of the shroud may be considered the shroud surface in the circumferential direction of the turbine or in the axial direction thereof (see also FIG. 1 in this regard).

Some or all of the embodiments of the present invention may have one, several or all of the advantages mentioned above and/or hereinafter.

Advantageously, the turbine blade according to the present invention may allow for a greater axial distance between the sealing tips (of the sealing lip) for the same shroud cutback, which enables improved coverage of the seal in the event of large axial displacements.

Advantageously, the turbine blade according to the present invention may have less weight than prior art turbine blades.

Due to an inclined sealing lip in combination with the cutting tooth, the turbine blade of the present invention may advantageously have reduced seal leakage.

The integrally formed part, where the surfaces of the cutting tooth, the sealing lip of the shroud and the extended cutting tooth or airfoil merge into one another, may advantageously eliminate the need for an accumulation of mass at the airfoil leading edge (in the main direction of flow incidence on the airfoil).

BRIEF DESCRIPTION OF THE DRAWINGS

The present invention will now be described, by way of example only, with reference to the accompanying drawings, in which identical or similar components are indicated by the same reference numerals. The figures are, in part, greatly simplified views, of which.

DETAILED DESCRIPTION

Figures 1A, 1B:
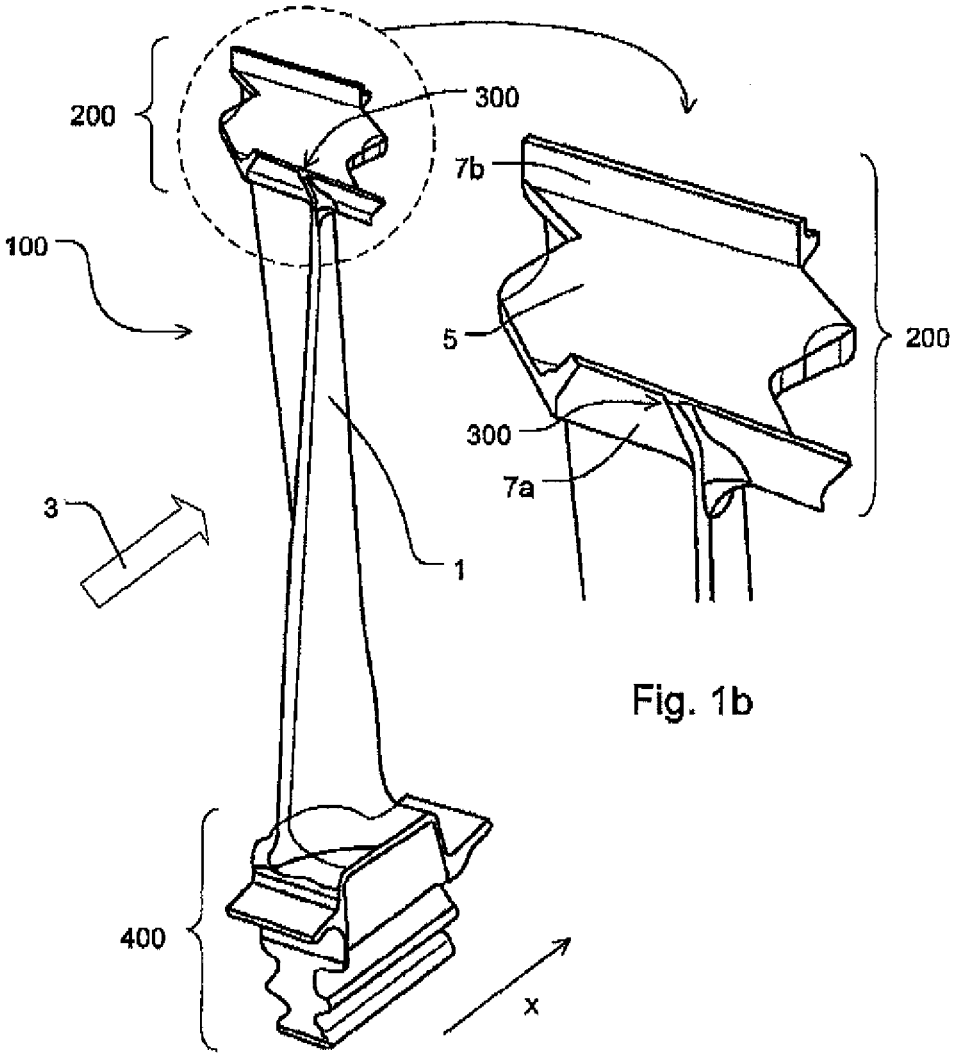
FIG. 1*a* is a schematic simplified perspective view of a turbine blade according to the present invention having a shroud and a cutting tooth.
FIG. 1*b* is an enlarged view of a detail of FIG. 1, showing the radial end portion of the turbine blade according to the present invention.

FIG. 1*a* depicts, in a simplified schematic perspective view, a turbine blade 100 according to the present invention, including a shroud 200, a cutting tooth 300, an airfoil 1 and a main direction of flow incidence 3 extending in the x-direction.

Shroud 200 is located at the radial end of airfoil 1.

The entire turbine blade 100 including shroud 200, cutting tooth 300, and a blade root 400 may be manufactured as a casting.

FIG. 1*b* is a detail of FIG. 1*a*, showing an enlarged view of the radial end portion of the turbine blade 100 according to the present invention, including shroud 200 and cutting tooth 300.

Shroud 200 has a top surface 5, which is bounded by a sealing lip 7*a* located upstream (with respect to the main direction of flow; i.e., in the x-direction) and a downstream trailing sealing lip 7*b*. Sealing lips 7*a*, 7*b* are intended to prevent the medium passing through from flowing past the radially outer edge of turbine blade 100 between the turbine blade and the turbine casing, but rather to cause it to flow against airfoil 1, thereby contributing to the transfer of energy by turbine blade 100.

Figure 2:
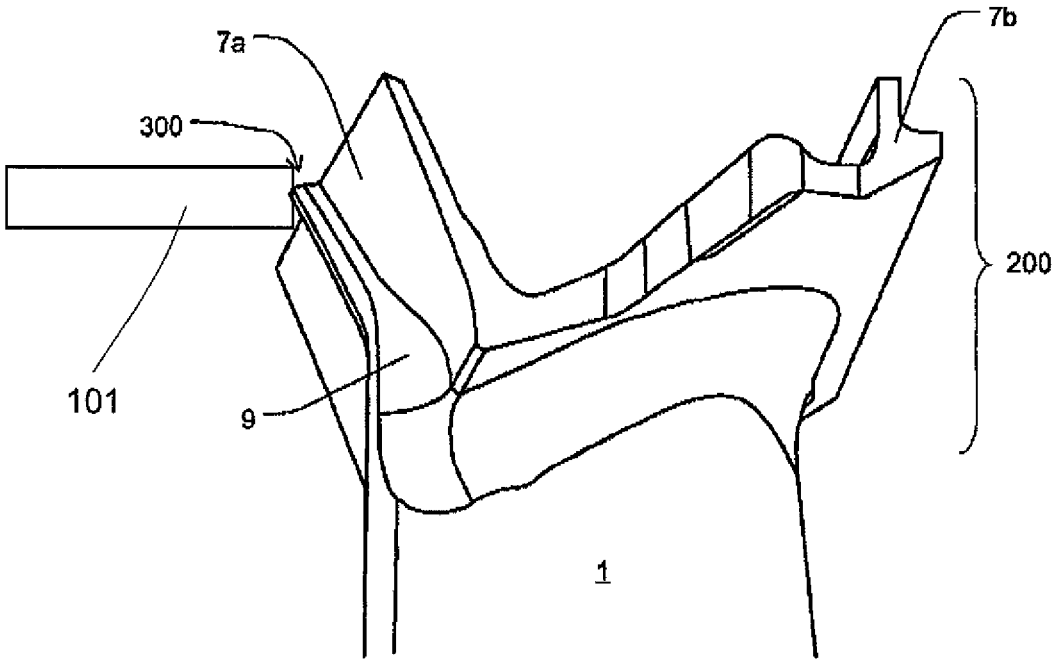
FIG. 2 is a side view showing the shroud with the cutting tooth.

FIG. 2 shows shroud 200 including leading sealing lip 7*a* and trailing sealing lip 7*b*, cutting tooth 300, as well as a portion of airfoil 1. FIG. 2 is a side view. In certain embodiments of the present invention, the cutting tooth is intended to cut into a portion of the turbine casing lining 101, shown schematically.

Airfoil 1 is connected to cutting tooth 300 by an airfoil extension 9. Hence, cutting tooth 300 may be referred to as a portion or integral portion of airfoil 1.

Furthermore, both cutting tooth 300 and airfoil 1 are also connected by airfoil extension 9 to shroud 200 via leading sealing lip 7*a*, which is a portion of shroud 200. The unit including cutting tooth 300, blade portion 9, and leading sealing lip 7*a* may be configured as an integral portion of turbine blade 100.

Figure 3:
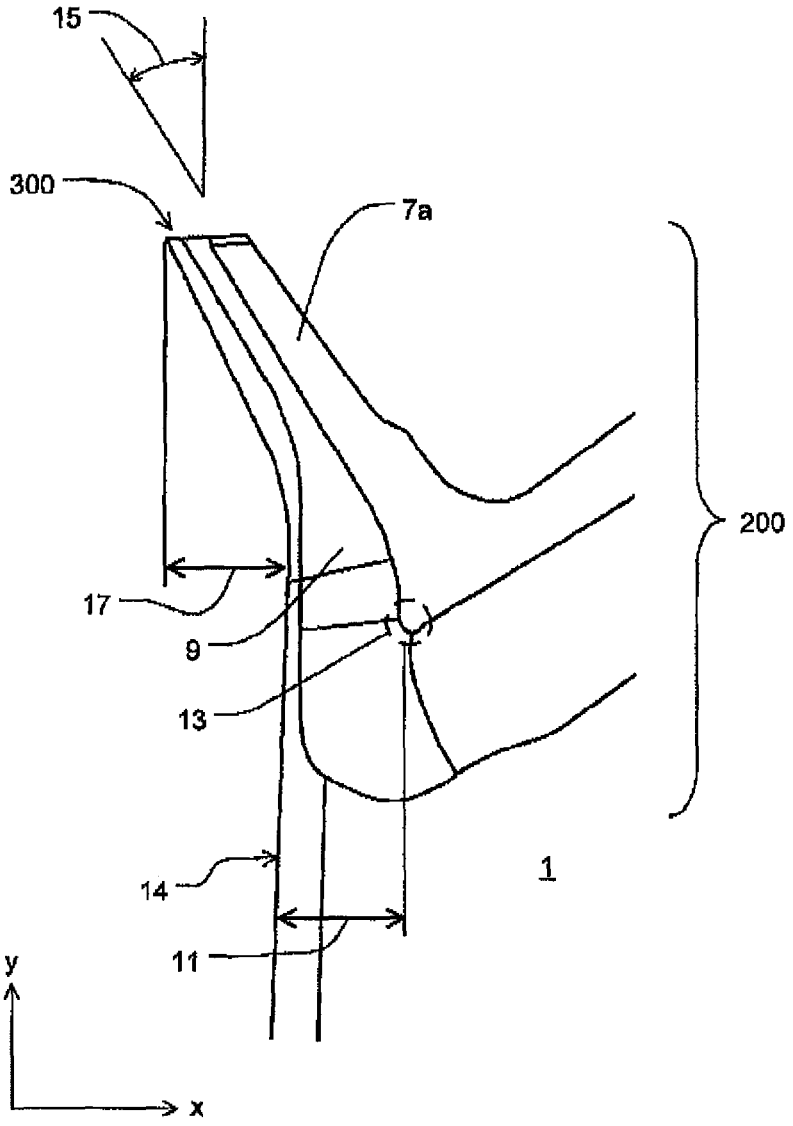
FIG. 3 is a further side view showing the shroud of FIG. 2 with the cutting tooth.

FIG. 3 shows shroud 200 including leading sealing lip 7*a*, cutting tooth 300, as well as a portion of airfoil 1. FIG. 3 shows a detail from FIG. 2 in a further view.

In FIG. 3, a shroud cutback 11 is shown as the distance between leading edge 13 of the base area of shroud 200 and the leading end of airfoil 1 (located upstream with respect to the main direction of flow in the x-direction). In accordance with the present invention, leading sealing lip 7*a* is inclined or tilted forwardly (i.e., against the x-direction), in the embodiment shown in FIG. 3, for example, by an angle of inclination 15 of about 33 degrees. Moreover, in accordance with the present invention, leading sealing lip 7*a* is not only inclined forwardly, but also extends beyond shroud cutback 11. In FIG. 3, this extent beyond shroud cutback 11 is illustrated by distance 17.

The extent of leading sealing lip 7*a* beyond shroud cutback 11, together with the integration or merging of airfoil 1 with cutting tooth 300 via airfoil extension 9, provides an advantageous structural design, for example, in terms of stiffness. Airfoil extension 9 may also be understood to be a "supporting rib" under leading sealing lip 7*a* of shroud 200.

Figure 4:
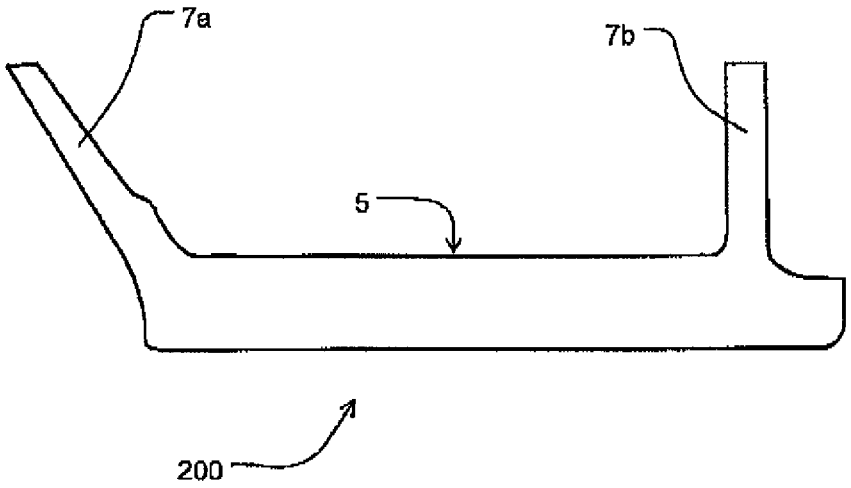
FIG. 4 is a cross-sectional view through the shroud shown in FIG. 1*b*.

FIG. 4 shows a cross section through the shroud 200 of turbine blade 100 shown in FIG. 1*b*. Leading sealing lip 7*a* and trailing sealing lip 7*b* of shroud 200 both extend radially beyond top surface 5 of shroud 200. In a cross-sectional plane which corresponds to the plane of the drawing of FIG. 4 and which is perpendicular to shroud top surface 5 and extends in the axial direction of turbine blade 100, shroud top surface 5 and the leading and trailing sealing lips 7*a*, 7*b* together form the shape of a trapezoid or of a rectangular trapezoid, as shown in FIG. 4.

List of Reference Numerals

| Reference Numeral | Description |
|---|---|
| 100 | turbine blade |
| 101 | turbine casing lining |
| 200 | Shroud |
| 300 | cutting tooth |
| 400 | blade root |
| 1 | Airfoil |
| 3 | main direction of flow incidence |
| 5 | shroud top surface |
| 7a | leading sealing lip |
| 7b | trailing sealing lip |
| 9 | airfoil extension |
| 11 | shroud cutback |
| 13 | outer edge of the base area of the shroud |
| 14 | leading end of the airfoil |
| 15 | inclination angle |
| 17 | distance; extent beyond the shroud cutback |

What is claimed is:

1. A turbine blade comprising:

an airfoil;

at least one shroud or shroud segment in a radially outer region; and at least one cutting tooth for engaging at least once into at least one abradable coating of a turbine casing during operation of the turbine blade, the cutting tooth connected to the shroud or the shroud segment;

wherein the cutting tooth is a portion of the airfoil.

2. The turbine blade as recited in claim 1 wherein the cutting tooth is integral with the shroud or of the shroud segment.

3. The turbine blade as recited in claim 1 wherein the cutting tooth is a stiffening element for the shroud or the shroud segment.

4. The turbine blade as recited in claim 1 wherein at least one portion of the shroud is extended beyond a shroud cutback.

5. The turbine blade as recited in claim 4 wherein the portion of the shroud extended beyond the shroud cutback is inclined at least 10 degrees relative to a longitudinal blade axis against a main direction of flow of the turbine blade.

6. The turbine blade as recited in claim 1 wherein the shroud has a leading sealing lip and a trailing sealing lip, the leading and trailing sealing lips extending radially beyond a top surface of the shroud, and wherein the leading sealing lip is longer than the trailing sealing lip.

7. The turbine blade as recited in claim 1 wherein the shroud has a leading sealing lip and a trailing sealing lip, the leading and trailing sealing lips extending radially beyond a top surface of the shroud, and wherein the shroud, with the leading and trailing sealing lips, has the shape of a trapezoid or rectangular trapezoid in a cross-sectional plane through the turbine blade perpendicular to the shroud top surface and extending in the axial direction of the turbine blade.

8. A turbine blade comprising:

an airfoil;

at least one shroud or shroud segment in a radially outer region; and at least one cutting tooth for engaging at least once into at least one abradable coating of a turbine casing during operation of the turbine blade, the cutting tooth connected to the shroud or the shroud segment;

the airfoil having a curved extension extending along a front side of the shroud or shoud segment, the cutting tooth being a portion of the extension.

* * * * *